US009375042B1

(12) United States Patent
Koziol

(10) Patent No.: US 9,375,042 B1
(45) Date of Patent: Jun. 28, 2016

(54) MOHAWK CAP

(71) Applicant: Brian Koziol, St Augustine, FL (US)

(72) Inventor: Brian Koziol, St Augustine, FL (US)

( * ) Notice: Subject to any disclaimer, the term of this patent is extended or adjusted under 35 U.S.C. 154(b) by 77 days.

(21) Appl. No.: 13/731,449

(22) Filed: Dec. 31, 2012

(51) Int. Cl.
*A42B 1/00* (2006.01)

(52) U.S. Cl.
CPC ..... *A42B 1/004* (2013.01)

(58) Field of Classification Search
CPC ..... A42B 1/24; A42B 1/248; A42B 1/247; A42B 1/004
USPC ..... 2/171, 209.12, 209.13, 209.5, 175.1, 2/195.1, 182.3
See application file for complete search history.

(56) References Cited

U.S. PATENT DOCUMENTS

| | | | | |
|---|---|---|---|---|
| 2,897,511 | A * | 8/1959 | Blair | 2/209.13 |
| D284,517 | S | 7/1986 | Gray | |
| 5,509,145 | A | 4/1996 | Stevenson et al. | |
| 5,799,334 | A * | 9/1998 | Griffith et al. | 2/195.1 |
| 5,903,926 | A * | 5/1999 | Fleming | 2/209.13 |
| 5,924,139 | A * | 7/1999 | Van Den Heuvel | 2/209.13 |
| D422,777 | S * | 4/2000 | Scott | D2/869 |
| D501,957 | S * | 2/2005 | Jagger | D29/122 |
| 7,010,815 | B2 | 3/2006 | Tufano-Sisca | |
| 7,047,571 | B1 | 5/2006 | Kelly | |
| 7,146,649 | B2 * | 12/2006 | Kronenbeger | 2/195.1 |
| 7,398,562 | B2 * | 7/2008 | Mollo | 2/425 |
| D611,200 | S * | 3/2010 | Packard | D29/122 |
| 7,836,522 | B2 * | 11/2010 | Blecha | 2/207 |
| 8,051,497 | B1 * | 11/2011 | Erhardt | 2/175.6 |
| D674,970 | S * | 1/2013 | Ratner et al. | D29/102 |
| 2003/0088904 | A1 * | 5/2003 | Taguchi | 2/171 |
| 2004/0163157 | A1 * | 8/2004 | Kronenberger | 2/171 |
| 2007/0017003 | A1 | 1/2007 | Harris et al. | |
| 2007/0143906 | A1 | 6/2007 | Renteria | |
| 2007/0256213 | A1 | 11/2007 | Dunavin | |
| 2009/0205107 | A1 * | 8/2009 | Coba | 2/171.2 |
| 2009/0255030 | A1 * | 10/2009 | Guy | 2/84 |
| 2012/0073032 | A1 * | 3/2012 | Tigan et al. | 2/209.13 |
| 2012/0174288 | A1 * | 7/2012 | Kovalov | 2/209.12 |

* cited by examiner

*Primary Examiner* — Shaun R Hurley
*Assistant Examiner* — Andrew W Sutton
(74) *Attorney, Agent, or Firm* — Lawrence J. Gibney, Jr.

(57) ABSTRACT

In order to highlight a person's hairstyle and specifically a Mohawk style a piece of head gear with a removable insert can be used. The head gear can take many forms including a baseball cap, for instance. The insert can be removed to highlight the hairstyle. Because the piece of headgear will be exposed to the elements it should be made of durable material and material that is used currently with baseball caps will be satisfactory.

13 Claims, 9 Drawing Sheets

MOHAWK CAP

BACKGROUND OF THE INVENTION

A. Field of the Invention

This relates to head gear, in particular, either a hat or a helmet to display a Mohawk haircut. If desired, it may also cover the head, which is contemplated.

B. Prior Art

There are many other prior art references to caps or head gear. There are also examples of head gear that have openings in the top section of the hat or cap.

A representative example of this type of device can be found at Stevenson, U.S. Pat. No. 5,509,145. In this reference there is a small opening in the top or center of the hat. The opening, however, does not extend from the front to the back of the hat.

Other examples in the prior art that have opening in ball caps include Griffith, U.S. Pat. No. 5,799,334. In this reference the openings are on the side of the cap to accommodate pigtails but the opening does not extend from front to back.

An example of a piece of head gear with a distinctive clump of hair can be found at Scott, D422,777, which is a piece of head wear with a decorative plume of Mohawk, which is not removable.

Other examples include Harris U.S. Publication 2007/0017001 which is a cap with a removable and rotatable visor and Tufano-Sisca U.S. Pat. No. 7,010,815, which is a cap for encircling the wearer's hair. Another example in the prior art can be found at Renteria, U.S. Patent Publication 2007/0143906 which is a cap with Velcro attachment panels.

BRIEF SUMMARY OF THE INVENTION

This device is a hat or a helmet to be worn by the user. It will have a removable piece along the center from the front to the back so that a person with a Mohawk hair style may proudly display the Mohawk hairstyle. This type of hairstyle is currently popular with some professional athletes and entertainers. It is a single row of hair that is centered in the middle of the head and extends from the front to the back of the head at a predetermined width and height.

The sides of the head of the individual who sports this hairstyle is cut close of the head or shaved to highlight the hairstyle and for dramatic effect.

With the detachable centerpiece the person may also give the appearance of the Mohawk hairstyle without actually having this particular type of hairstyle. This is due to the fact that with the exposed hair, it will highlight the hair that is present.

The insert of this device will be a predetermined width and will either be attached from the outside of the hat or the inside of the hat and will have a variety of attachment means that can be used including snaps and buttons, hook and loop assembly means, a zipper or tie straps.

It is anticipated that this type of design will be used on a variety of caps. Representative examples of the type of hats would include low-profile, mid-profile, high-profile, structured, semi-structured or unstructured. It is anticipated that the design will also be used with adjustable caps and both pro-style, fitted and flex-fit caps as well. The design may also be used with a five panel or a six panel hat and will come in a variety of different shapes to accommodate a variety of head sizes from children to adults.

The traditional baseball cap or hat is usually five or six panels although a cap or hat with less than five or six panels may be used. Although the traditional baseball cap is mentioned in this application, the design may also be used with any type of cap to include but not limited to the following: ballcap, tuque, knit hat, ski cap, ascot, akubra, balaclava, bonnet, barretina, beanie, boater, booney, beret, boss, bowler/derby, bucket, chullo, cowboy, fedora, flat cap, Gatsby, panama, rasta cap, skullcap, sombrero, top hat, trilby, leather, or trucker.

This design may also be used with helmets including but not limited to helmets that are used in the following activities: baseball including batting and catcher masks, cycling, skating (inline, roller or ice), skateboarding, ski or snowboarding, motorcycle, mountain climbing, football, lacrosse and car racing.

Because this device will be subjected to the elements, it can be made from material that is commonly used in baseball caps currently. Other material that may be used could include fleece, wool felt or velvet, among others.

NUMBERING DESCRIPTION

5—Device
10—Hat
15—Insert
20—Opening
25—Attachment means of snaps and buttons
30—Attachment means of a hook and loop assembly
35A—Alignment means on the cap
35B—Alignment means on the insert

DETAILED DESCRIPTION OF THE EMBODIMENTS

This device 5 is a piece of head gear 10 that will have an opening 20 from the front of the head gear to the back of the head gear 10. An insert 15 that can be removed will cover the opening 20 and can be attached to the head gear 10 at the opening around the perimeter of the opening. The insert 15 can be removed or reattached depending on the tastes of the user.

The insert 15 may also be reversible from the front to the back of the hat as well as being able to be flipped over for added effect if desired.

Figure 1:
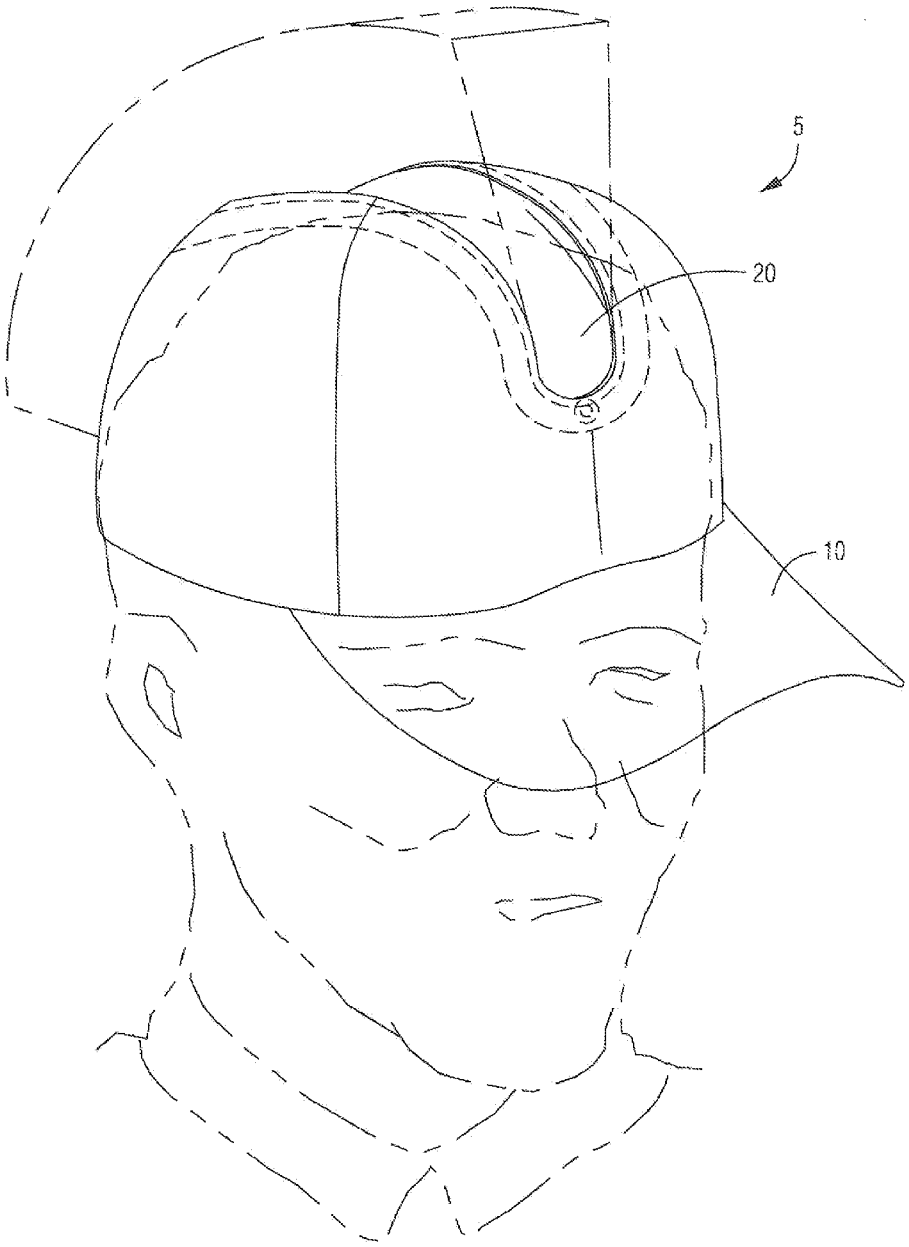
FIG. 1 is an isometric view of the device with the insert taken out with a representation of the Mohawk hairstyle in dashed lines.
Figure 2:
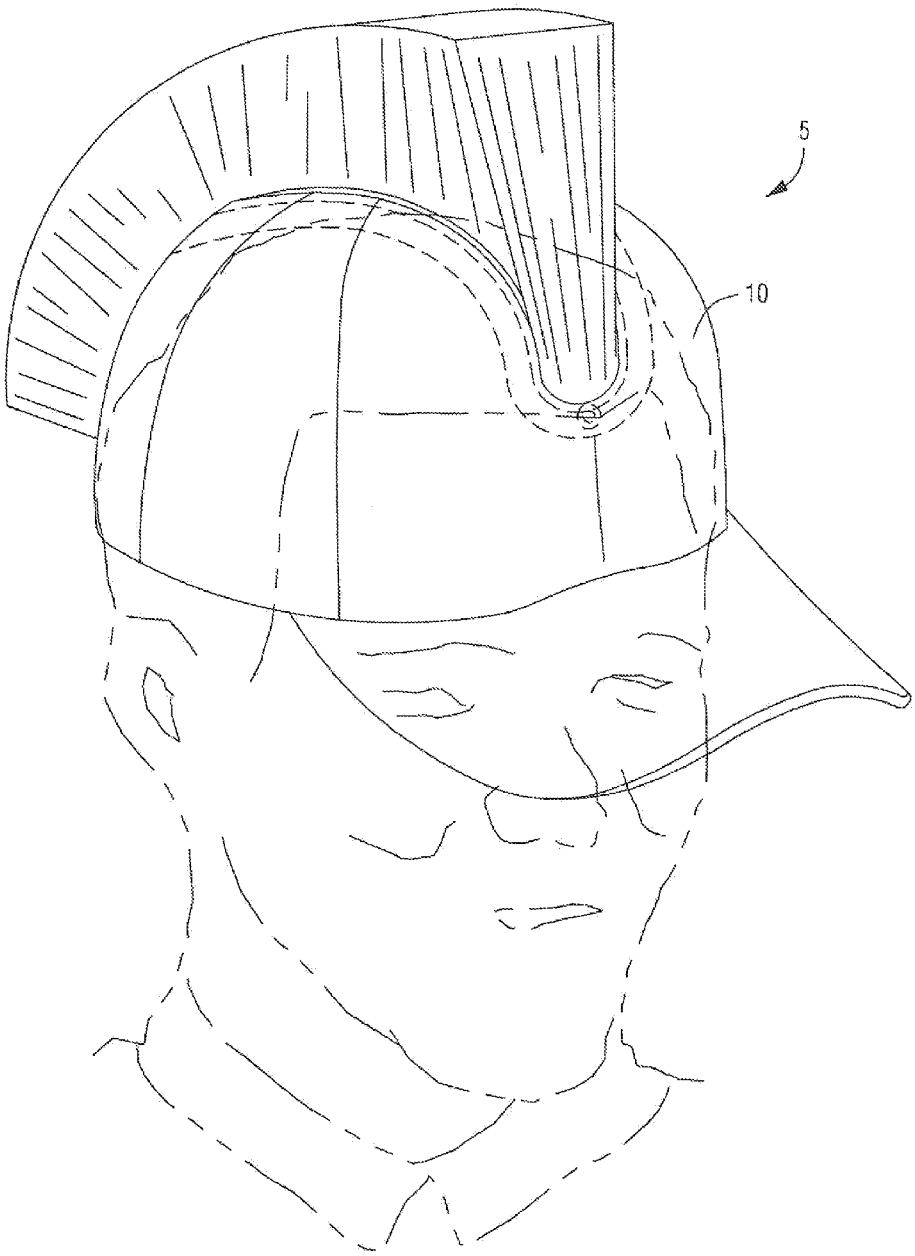
FIG. 2 is a view of the device in use depicting the Mohawk hairstyle.

The purpose of this device 5 is to highlight a Mohawk hairstyle; this type of hairstyle has a center section of a predetermined width with longer hair and typically hair on the sides of the person's head that is cut close to the person's head. When this device is worn without the insert 15 the section of hair in the center will protrude outside the opening such as depicted in FIG. 2.

The user may also desire to wear this head gear 10 to highlight a particular hairstyle in such a fashion as to give the appearance that the person has a Mohawk without actually having this type of hairstyle. With this cap the user would remove the insert so that the person's hair would protrude from the opening and draw attention to the person's hair.

For purposes of this application a baseball cap will be discussed as an example of the head gear that may be worn by the user although the concept may be used with any type of head gear. The exact piece of head gear may be soft or hard and may come in a variety of shapes, sizes or designs.

The baseball cap 5 will be worn like any other baseball cap. An insert 15 may be placed over or under the opening in the approximate center of the cap and will extend from the front of the cap to the back. The exact length of the opening will be dictated by cosmetic concerns. For instance, the front opening will start as close to the hairline as possible so that as little of the person's forehead will be visible while at the same time allowing the majority of the hair to protrude from the opening.

Additionally the insert and the cap may have a curved, tapered or straight front depending on the tastes of the consumer.

The insert 15 is easily removable by the user. In certain situations the user may wish to have the insert cover the opening and wear the device like a typical baseball cap.

Figure 9:
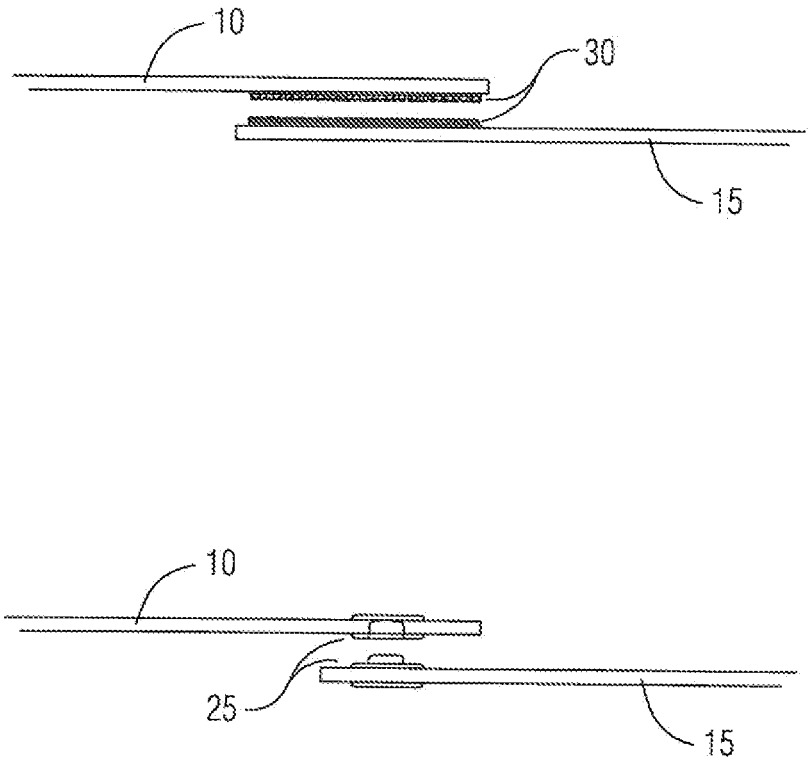
FIG. 9 is a depiction of various means of attachment for the cap and the insert.

The insert 15 can be attached to the interior of the cap by a variety of different attachment means, including snaps and buttons 25, a hook-and-loop assembly 30 or a zipper to name a few. Two of the choices of the means of attachment are depicted in FIG. 9. There are other means to close and the previously mentioned closure means are representative examples and not exhaustive.

The insert 15 should be slightly larger than the opening in the cap to provide enough surface area to attach the insert to the cap and to insure that the insert remains in place during normal use.

Figure 8A:
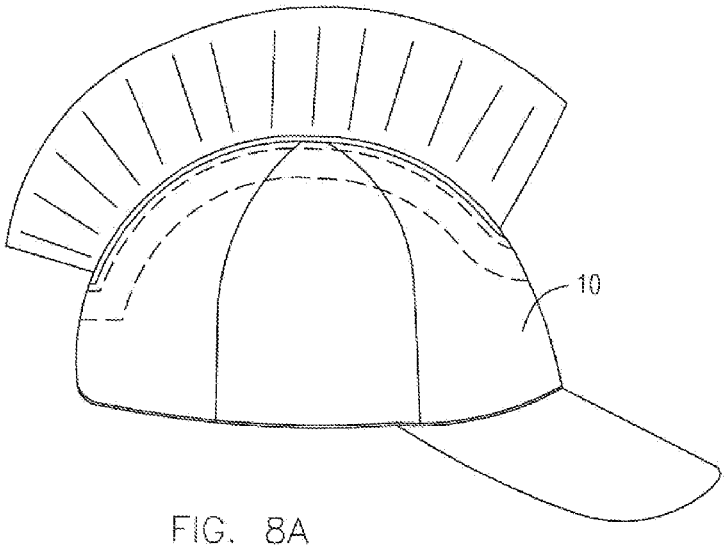
FIG. 8A is a side view of the cap with a detachable hairpiece.
Figure 8B:
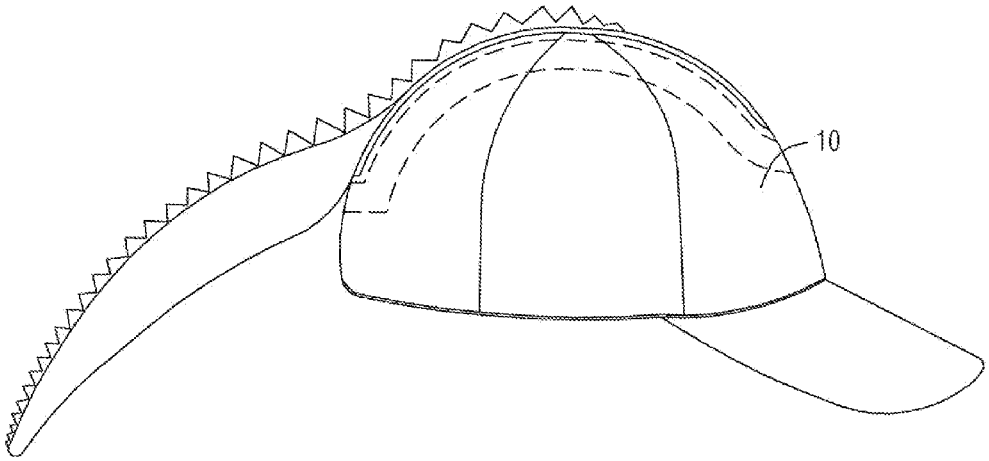
FIG. 8B is a side view of the cap with a detachable head gear design.

For added effect the insert 15 may have a particular design such as depicted in FIGS. 8A and 8B.

Figure 3:
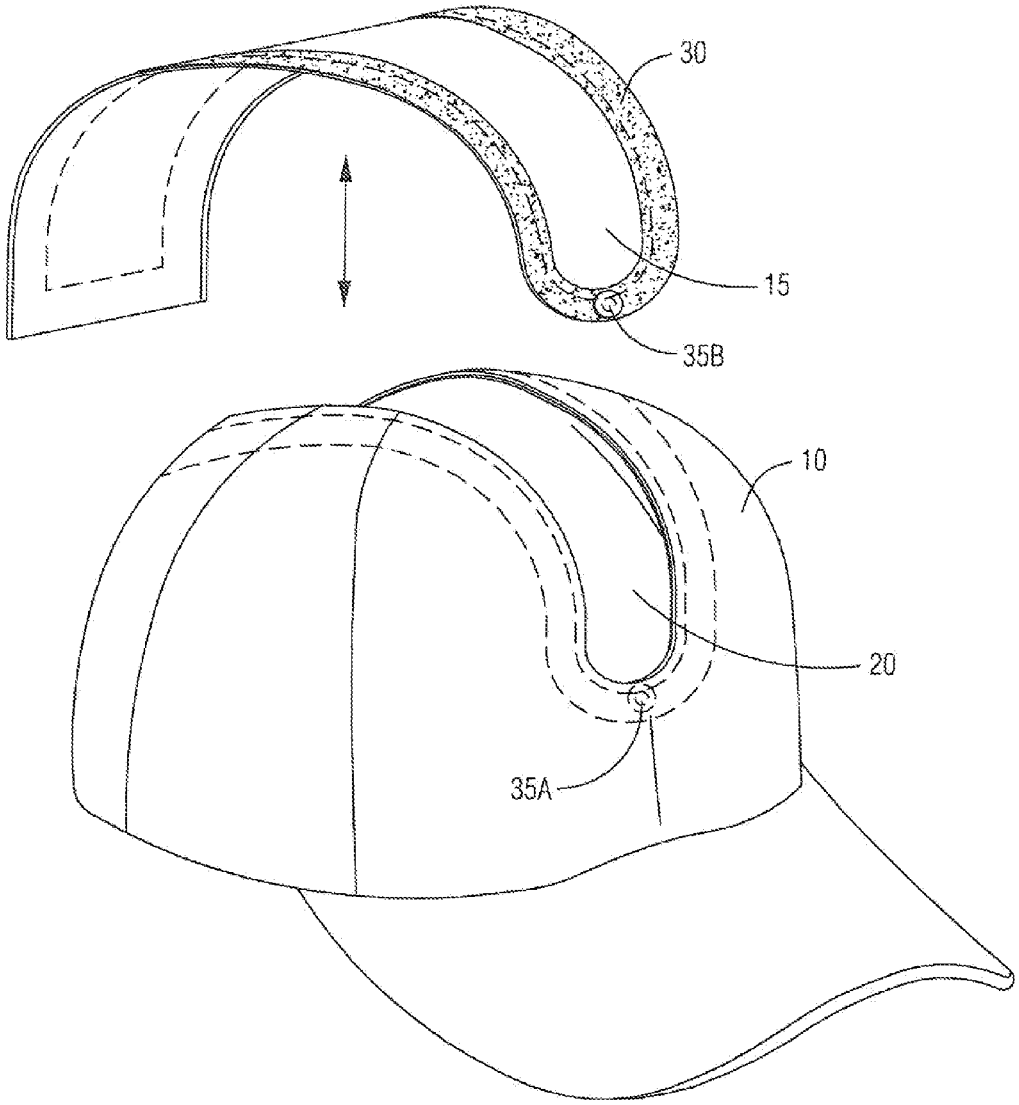
FIG. 3 is an exploded view of the device depicting the insert positioned above the hat.
Figure 4:
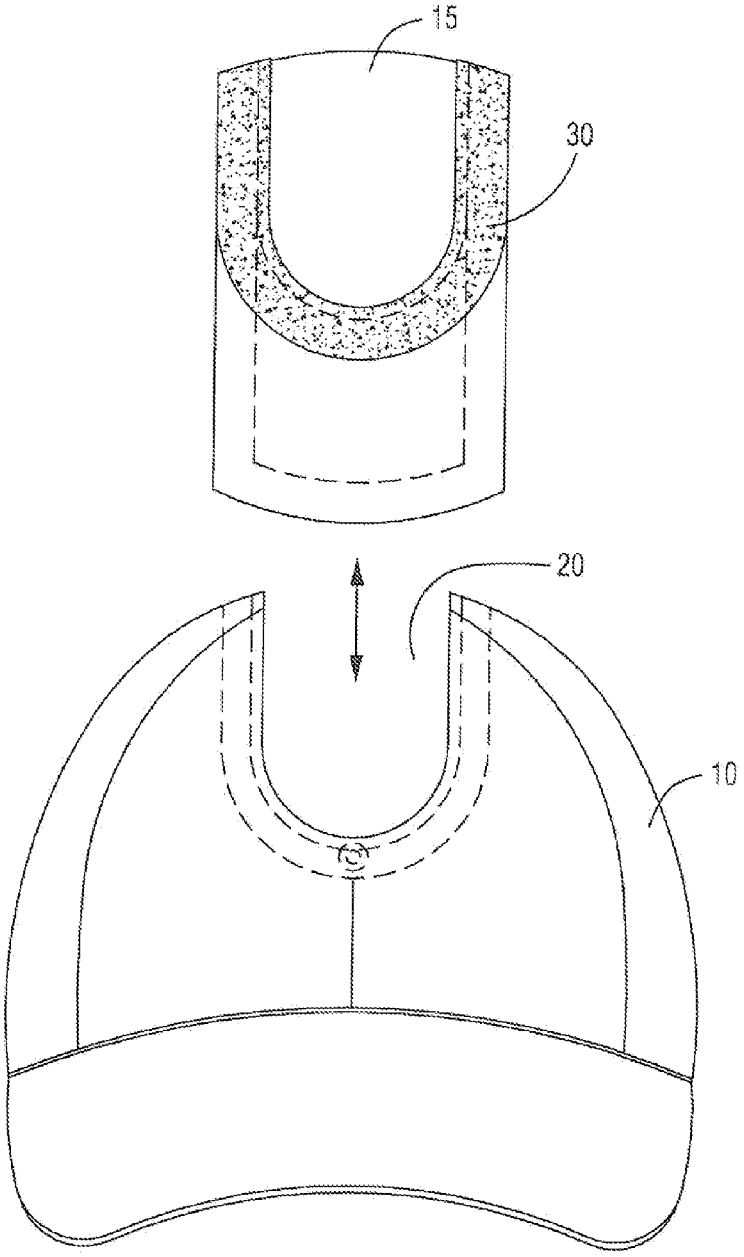
FIG. 4 is a front view of the device with the insert positioned about the hat.
Figure 5:
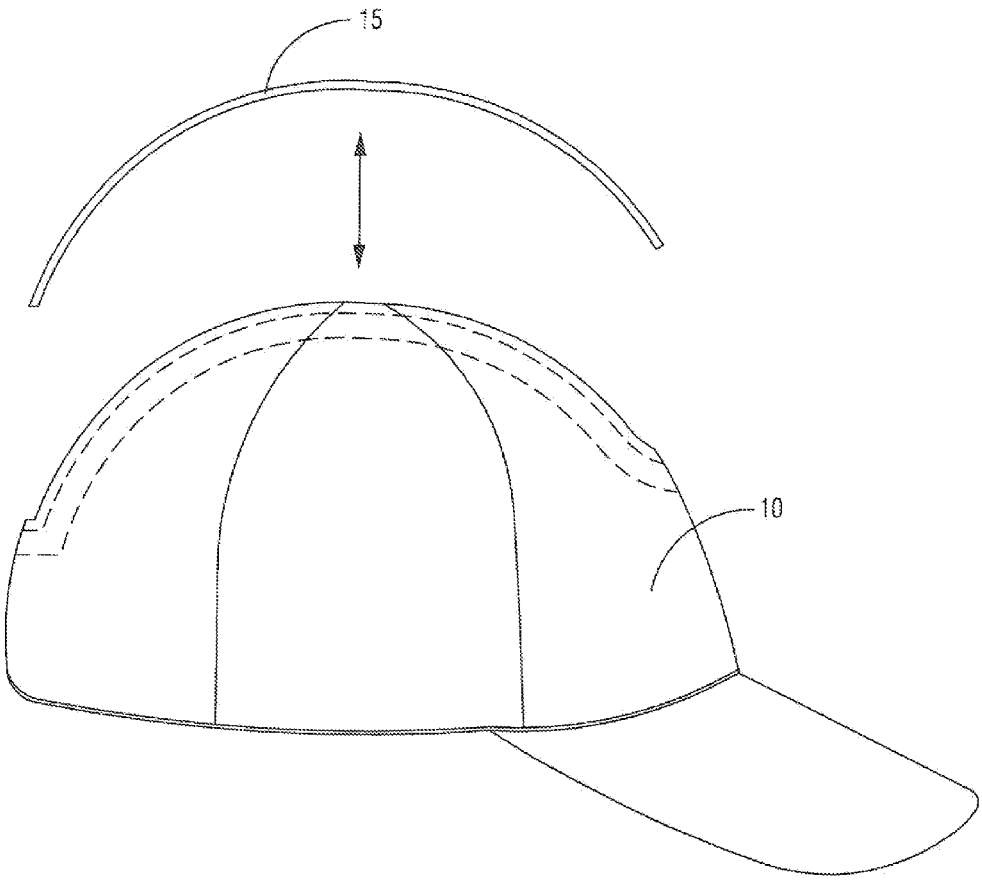
FIG. 5 is a side view of the device with the insert positioned above the hat.
Figure 6:
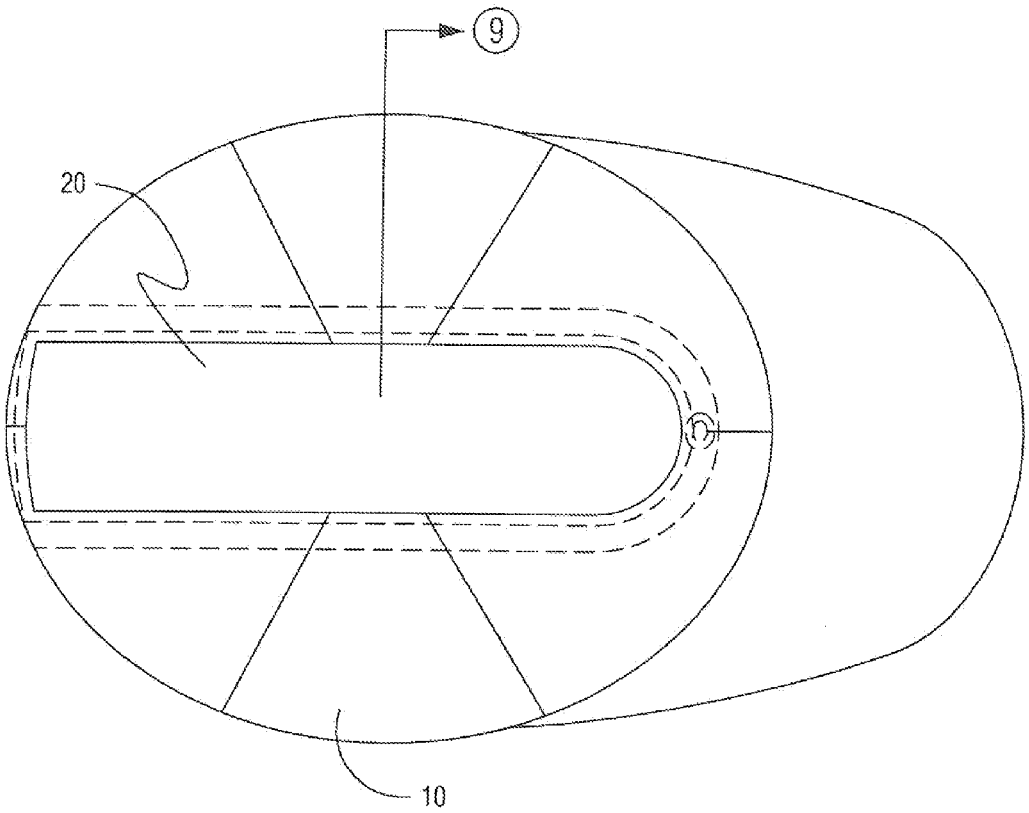
FIG. 6 is a top view of the device depicting the opening without the insert in place.
Figure 7:
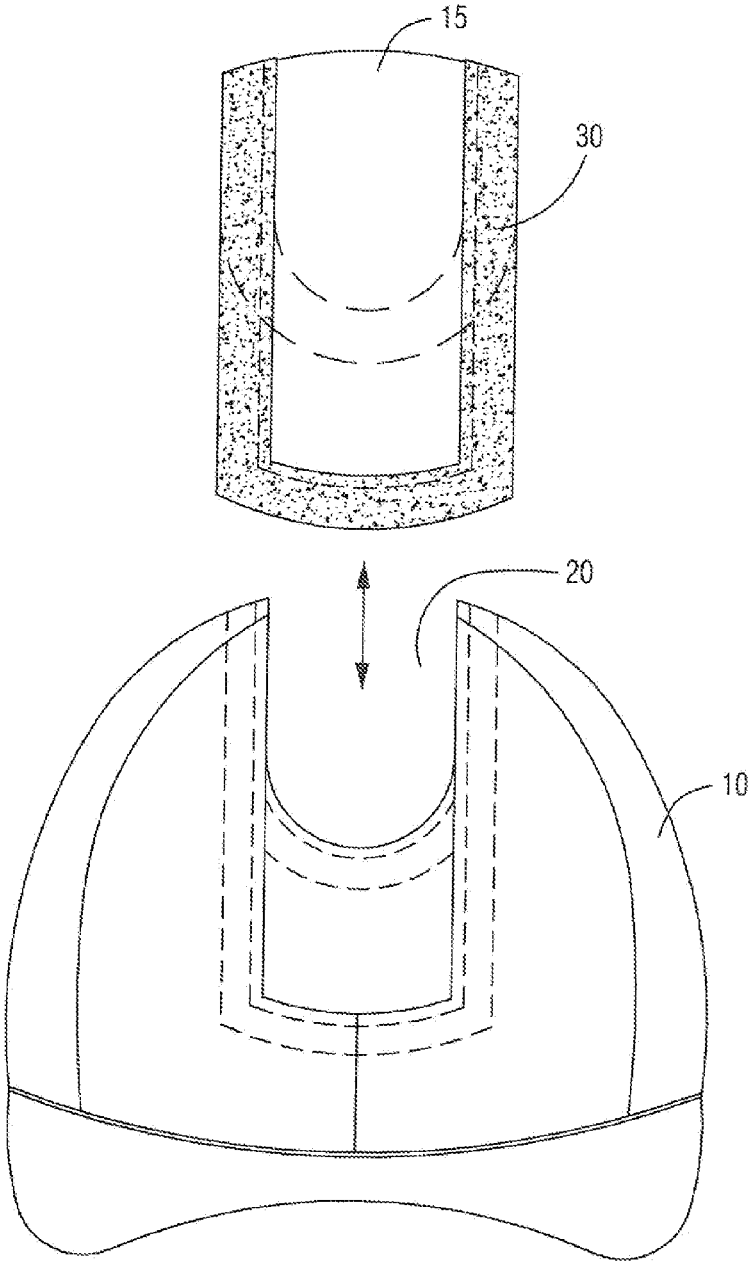
FIG. 7 is a back view of the device with the insert positioned above the opening of the hat.

If the hook and loop assembly is used for the means of attachment, the hook portion may extend around the perimeter of the insert such as depicted in FIG. 3. The corresponding loop portion of the means of attachment would line the interior of the cap. The positioning of the hook and loop portions may be reversed as well.

Regardless of the exact placement of the various parts of the means of attachment, the comfort of the wearer of this device is paramount. For instance, because the Mohawk hairstyle has a center piece with shaved sides, the means of attachment should not be uncomfortable for the wearer.

The means to attach the insert to the opening may be around the perimeter of the insert and/or it may be on the perimeter of the opening. Regardless of the exact placement of the means to attach it should also provide enough strength to keep the insert firmly attached over the opening while at the same time affording maximum comfort in terms of wearing the cap so as not to chafe the person's scalp.

Additionally the attachment means may likely be sewn into the hat to provide support to the hat and to aid in the hat's durability. There will be a first portion of the attachment means that is sewn to the perimeter of the opening in the cap and a second portion of the attachment means that is attached to the perimeter of the opening of the insert.

There should be sufficient surface area of the attachment means on both the insert and the opening so that the attachment is secure. Some of the attachment means may also overlap the opening to insure that the attachment is secure.

There may be some supporting member such as reinforcing cloth or plastic around the opening to provide additional durability for the hat. The attachment means may also alternate between the surfaces of the insert. For example the loop assembly may be sewn to the perimeter of the top and/or bottom of the insert attachment and the hook portion sewn to the interior and/or exterior of the cap or vice versa.

Regardless of the exact positioning of the attachment means it should be cosmetically and aesthetically pleasing to the consumer.

In order to properly position the insert 15 when it is worn in place a means to align the insert is provided. In the front of the cap will be a means to align 35A with a corresponding alignment means on the inert 35B. Different types of means of alignment may be used such as a hook and loop assembly or a snap and button assembly or zipper. Regardless of the specific type of means of alignment, it will allow the user to position the insert in the opening so that it is properly centered.

The opening in the cap may be either squared shaped or tapered depending on the desire of the consumer and may also come in slightly different widths depending on the shape of the head of the person. Regardless of the specific shape the opening should be covered completely by the insert when the device will be used as an ordinary baseball cap.

In close proximity to the opening of the hat will be a means to align the insert with the fastening means. The means to align will likely be a piece of centering cloth or material. This centering means will allow the person to align the front of the insert, which will insure that the insert will be placed within the confines of the opening and cover any attachment means.

While the embodiments of the invention have been disclosed, certain modifications may be made by those skilled in the art to modify the invention without departing from the spirit of the invention.

The invention claimed is:

1. A piece of head gear with an opening, which is comprised of:

a piece of head gear;

wherein the piece of head gear is of a predetermined shape;

wherein the piece of head gear has a top section;

said top section covers the top of a person's head;

wherein an opening is provided on the top of the piece of head gear;

said opening is of a predetermined shape including two parallel sides;

wherein said opening extends from the front of the piece of head gear in an arcuate shape to a predetermined point on the back of the piece of head gear;

said opening is centered in the middle of the piece of head gear;

an insert;

wherein the insert covers the opening;

wherein the insert is removable;

wherein the insert is slightly larger than the opening;

a means to attach;

wherein the means to attach is further comprised of a first portion and a second portion;

wherein the means to attach is used to secure the insert to the piece of head gear;

wherein the first portion of the means to attach is secured to the opening of the piece of head gear;

wherein the second portion of the means to attach is secured to the perimeter of the insert;

wherein the insert is secured to the means to attach;

wherein a means to align the insert is provided;

said means to align the insert is provided on the cap and a corresponding means to align on the insert wherein the means to align is attached to the top of the means to attach on each the cap and the insert.

2. The piece of head gear with an opening as described in claim 1 wherein the means to attach are snaps and buttons.

3. The piece of head gear with an opening as described in claim 1 wherein the means to attach is a hook-and-loop assembly.

4. The piece of head gear with an opening as described in claim 1 wherein the means to attach is a zipper.

5. The piece of head gear with an opening as described claim 1 wherein the head gear is rigid.

6. The piece of head gear with an opening as described in claim 1 wherein the head gear is not rigid.

7. The piece of head gear with an opening as described in claim 1 wherein the means to align is positioned in the interior of the head gear.

8. The piece of head gear with an opening as described in claim 1 wherein the means to align is positioned on the exterior of the head gear.

9. The piece of head gear with an opening as described in claim 1 wherein the insert has a design on the outside surface of the insert.

10. The piece of head gear with an opening as described in claim 1 wherein the insert is placed over the opening.

11. The piece of head gear with an opening as described in claim 1 wherein the insert is placed under the opening.

12. The piece of head gear with an opening as described in claim 1 wherein the insert can be reversed from the front to the back of the piece of head gear.

13. The piece of head gear with an opening as described in claim 1 wherein the insert can be reversed from the top to the bottom of the piece of head gear.

* * * * *